US008231110B2

(12) United States Patent
Stoner

(10) Patent No.: US 8,231,110 B2
(45) Date of Patent: Jul. 31, 2012

(54) RETROFIT ROLL-OVER VALVE FOR CARBURETOR FLOAT BOWL VENT TUBE

(76) Inventor: Dale A. Stoner, Albuquerque, NE (US)

( * ) Notice: Subject to any disclaimer, the term of this patent is extended or adjusted under 35 U.S.C. 154(b) by 323 days.

(21) Appl. No.: 12/790,431

(22) Filed: May 28, 2010

(65) Prior Publication Data

US 2011/0291306 A1 Dec. 1, 2011

(51) Int. Cl.
*F02M 5/02* (2006.01)

(52) U.S. Cl. ..... 261/70; 137/43; 261/72.1; 261/DIG. 67

(58) Field of Classification Search ..... 261/70, 261/72.1, DIG. 67; 137/39, 43; 123/198 D, 123/198 DB, 198 E
See application file for complete search history.

(56) References Cited

U.S. PATENT DOCUMENTS

| | | | | |
|---|---|---|---|---|
| 1,814,118 | A * | 7/1931 | Bracke | 261/72.1 |
| 2,920,877 | A | 1/1960 | Spragle | |
| 3,020,030 | A * | 2/1962 | Capehart | 261/36.2 |
| 3,752,135 | A | 8/1973 | Peterson et al. | |
| 3,778,024 | A | 12/1973 | Rogerson | |
| 3,814,392 | A | 6/1974 | Boyd et al. | |
| 3,825,238 | A * | 7/1974 | Nishihara et al. | 261/36.2 |
| 3,939,232 | A * | 2/1976 | Higashigawa | 261/72.1 |
| 3,995,710 | A | 12/1976 | Courtot | |
| 4,011,848 | A | 3/1977 | Coddington | |
| 4,041,967 | A | 8/1977 | Tsukisaka | |
| 4,062,910 | A | 12/1977 | Rogerson et al. | |
| 4,157,366 | A | 6/1979 | Ruth et al. | |
| 4,283,356 | A | 8/1981 | Arai et al. | |
| 4,305,368 | A | 12/1981 | Phelan et al. | |
| 4,456,216 | A * | 6/1984 | Boruta | 251/11 |
| 4,728,467 | A * | 3/1988 | Nakagawa et al. | 261/72.1 |
| 5,273,008 | A | 12/1993 | Ditter | |
| 6,726,185 | B1 | 4/2004 | Del Sole | |
| 6,874,768 | B2 | 4/2005 | Grant | |
| 2005/0029684 | A1 * | 2/2005 | Yamada | 261/72.1 |
| 2006/0213553 | A1 * | 9/2006 | Mills et al. | 137/43 |
| 2006/0283501 | A1 * | 12/2006 | Devall | 137/43 |
| 2008/0105304 | A1 * | 5/2008 | Callahan et al. | 137/43 |
| 2009/0056662 | A1 | 3/2009 | Vogt et al. | |

FOREIGN PATENT DOCUMENTS

| | | | | |
|---|---|---|---|---|
| JP | 53-74632 A * | 7/1978 | | 261/DIG. 67 |

* cited by examiner

*Primary Examiner* — Richard L Chiesa
(74) *Attorney, Agent, or Firm* — Kenneth L. Green

(57) ABSTRACT

A roll-over valve attaches over an existing carburetor float bowl vent tube and closes when a car is involved in a crash to prevent or reduce fuel from escaping from a tilted or inverted carburetor and starting a fire. Carburetors are used in many special interest cars and race cars. The carburetors include float bowls containing fuel and the float bowls are vented to outside air by the carburetor vent tubes. The carburetor vent tubes are generally vertical tubes reaching upward from the carburetor into an air cleaner or the volume above the carburetor. The roll-over valve includes a compression fitting or other connector and is easily fitted to the carburetor.

14 Claims, 7 Drawing Sheets

RETROFIT ROLL-OVER VALVE FOR CARBURETOR FLOAT BOWL VENT TUBE

BACKGROUND OF THE INVENTION

The present invention relates to preventing or reducing fuel leaks during accidents and in particular to a roll-over valve to prevent or reduce fuel leaks from a carburetor when a race car rolls in an accident.

While fuel injection is commonly used in production automobiles, both enthusiasts and many classes in automobile racing use carburetors. In the past, fires resulting from accidents were both common and often life threatening. Many improvements have been made in the areas of fuel cells and fuel tank roll-over valves, reducing the occurrence of fires. Unfortunately, fires still result from fuel escaping from carburetors when cars roll over.

BRIEF SUMMARY OF THE INVENTION

The present invention addresses the above and other needs by providing a roll-over valve which attaches over an existing carburetor float bowl vent tube and closes when a car rolls in a crash to prevent or reduce fuel from escaping and starting a fire. Carburetors are used in many special interest cars and race cars. The carburetors include float bowls containing fuel and the float bowls are vented to outside air. The vents are generally vertical tubes reaching upward from the carburetor into an air cleaner or into a volume above the carburetor. The roll-over valve includes a compression fitting and is easily fitted to the carburetor.

In accordance with one aspect of the invention, there is provided a carburetor float bowl roll-over valve. The carburetor has at least one float bowl containing fuel and a cylindrical vertical float bowl vent tube extending upward from the carburetor and in fluid communication with the float bowl. The roll-over valve is fixed to the vent tube and includes a compression fitting nut and wedge, a body portion, a vertically sliding obstruction, and a top cap. The body portion includes a lower male threaded portion, a center portion, and an upper male threaded portion. The lower male threaded portion threadedly cooperates with the compression fitting nut to squeeze the compression fitting wedge radially to fix the roll-over valve on the vent tube. The center portion has an outside surface for cooperating with a tool. A vertical centered passage passes though the body portion and includes an inside shoulder forming a narrowing of the vertical centered passage. The vertically sliding obstruction resides inside the vertical centered passage above the inside shoulder, and bypass cuts in the vertical centered passage allow air to flow past the vertically sliding obstruction into and out of the float bowl to equalize pressure in the float bowl with ambient air pressure when the carburetor is upright. The top cap includes a cap lower portion having female threads for threadedly cooperating with the upper male threaded portion of the body portion, a port above the vertical centered passage in communication with ambient air, and a narrowing between the cap lower portion and the port to block passage of the vertically sliding obstruction into the port and to restrict an escape of fuel from the float bowl when the carburetor is sufficiently tilted or inverted.

In accordance with another aspect of the invention, there is provided a carburetor and roll-over valve. The roll-over valve is connected serially with a float bowl vent tube wherein all of a flow through the vent tube is restricted to also pass through the roll-over valve.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1B:
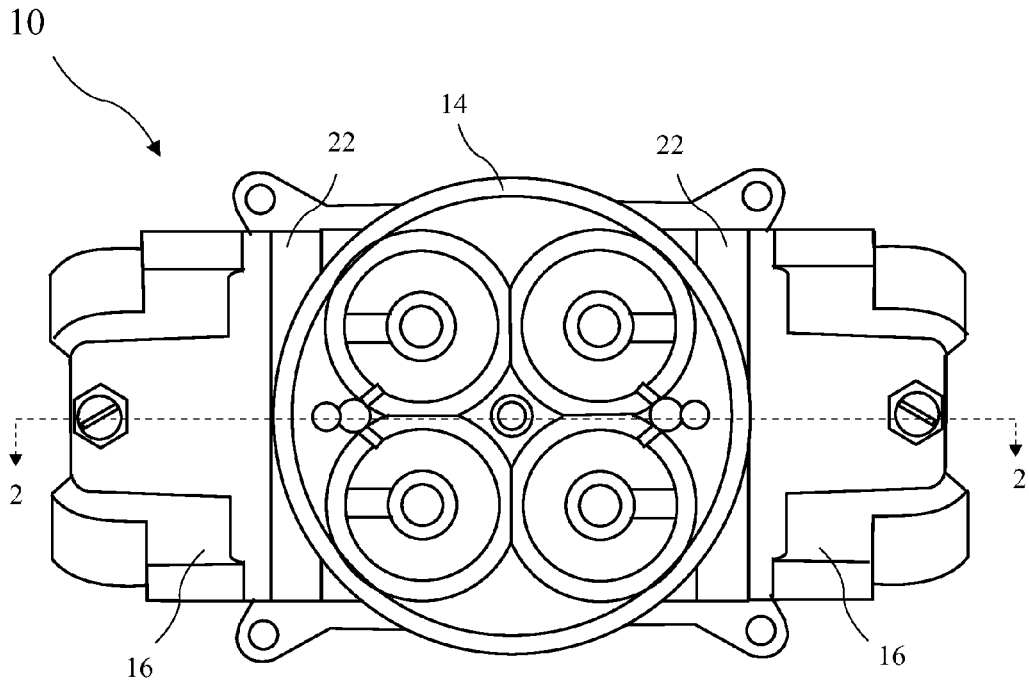
FIG. 1B is a top view of the carburetor.
Figure 1A:
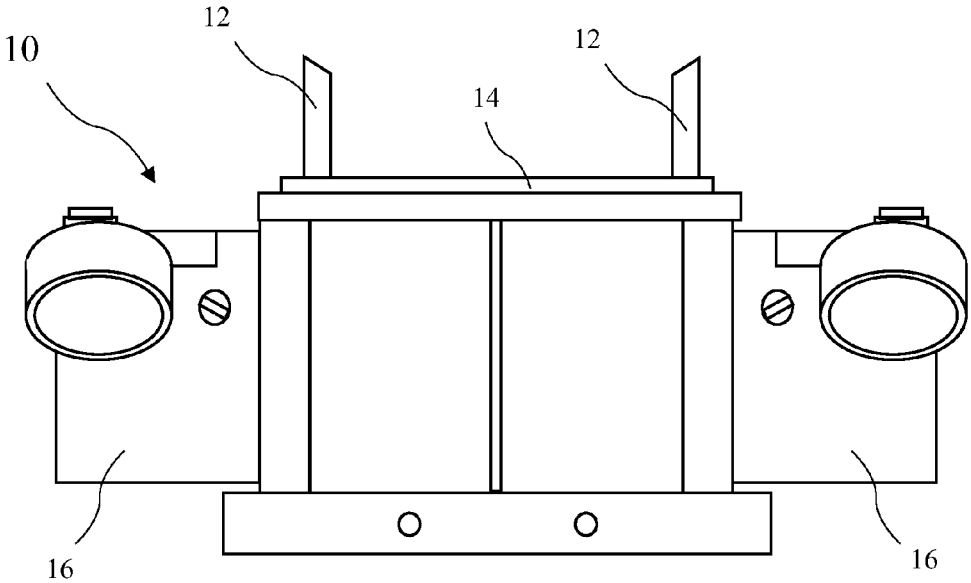
FIG. 1A is a side view of a carburetor.

A side view of a carburetor 10 is shown in FIG. 1A and a top view of the carburetor 10 is shown in FIG. 1B. The carburetor 10 is typical of four barrel carburetors used in many racing events and includes: float bowls 16, metering blocks 22, an air cleaner flange 14, and float bowl vent tubes 12. Other varieties of carburetors include one barrel carburetors, two barrel carburetors, and three barrel carburetors which may have one or two float bowls, but in general, nearly all carburetors include at least one float bowl and the float bowl has at least one float bowl vent. Engines commonly include one, two, three, four, or six carburetors.

Figure 2A:
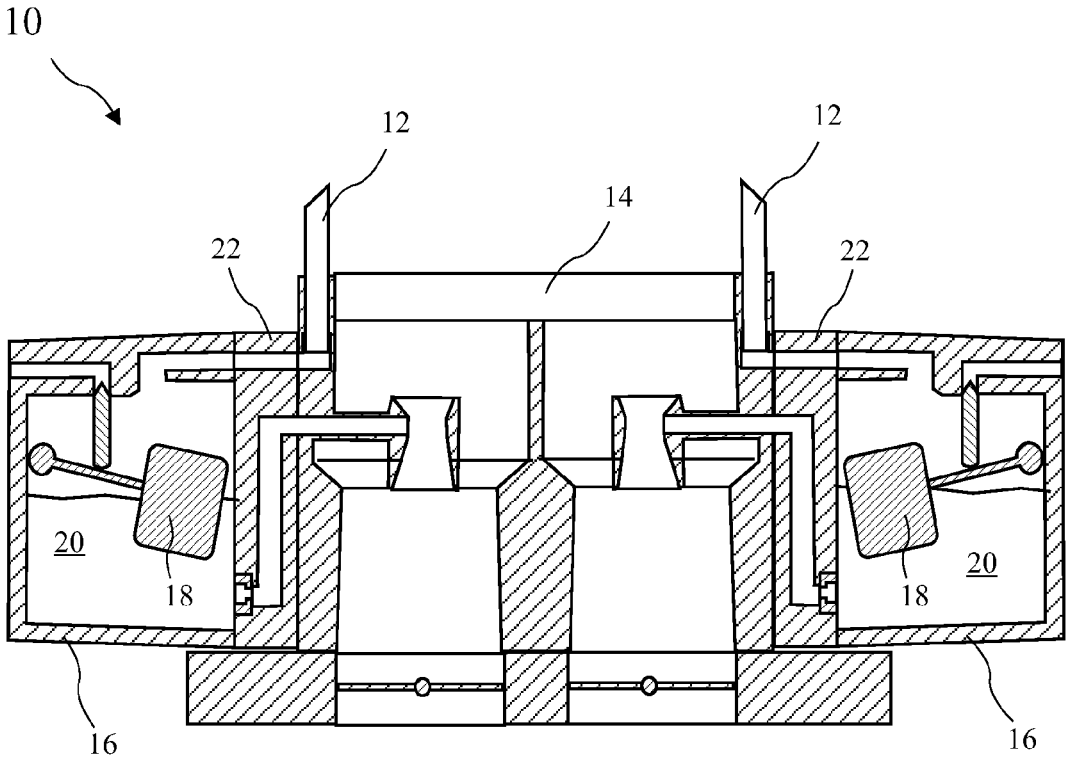
FIG. 2A is a cross-sectional view of the carburetor taken along line 2-2 of FIG. 1B.

A cross-sectional view of the carburetor 10 taken along line 2-2 of FIG. 1B is shown in FIG. 2A. The carburetor 10 further includes a float 18 in the float bowl 16, and fuel 20 inside the float bowl 16. The float controls a valve assembly to regulate the amount of fuel 20 inside the float bowl. The float bowl vent 12 vents the interior of the float bowl 16 to ambient air to provide neutral air pressure inside the float bowl. The float bowl vent is generally needed because pressure changes inside the float bowl will impact the fuel delivery to the engine.

Figure 2B:
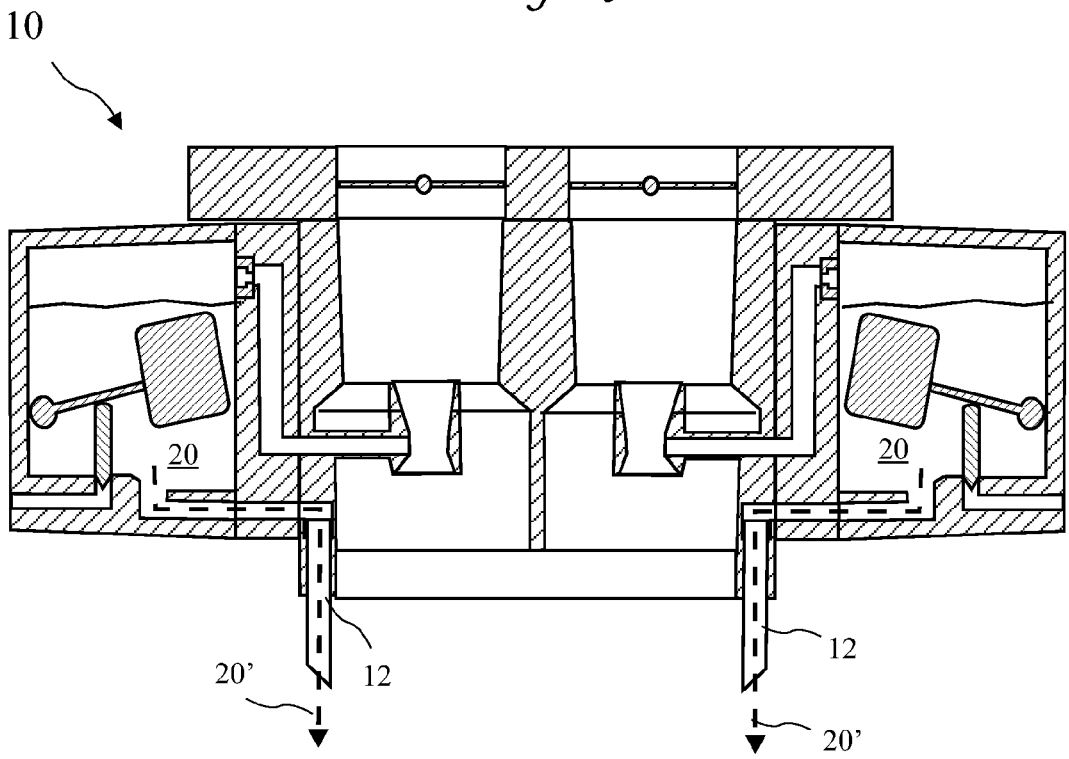
FIG. 2B is a cross-sectional view of the carburetor taken along line 2-2 of FIG. 1B with the carburetor inverted and fuel escaping from vent tubes of the carburetor.

A cross-sectional view of the carburetor 10 taken along line 2-2 of FIG. 1B with the carburetor 10 inverted and fuel 20 escaping through the vent tubes 16 is shown in FIG. 2B. In an accident, the unchecked flow of fuel 20 from the carburetor 10 of a hot engine is often the cause of fires. Such fires are extremely dangerous when combined with a crash on a race track because a driver may be injured or the driver's escape from the vehicle may be hampered by damage to the vehicle. Fuel may also escape from the float bowl 16 when the carburetor 10 is sufficiently tilted without being completely inverted.

Figure 3:
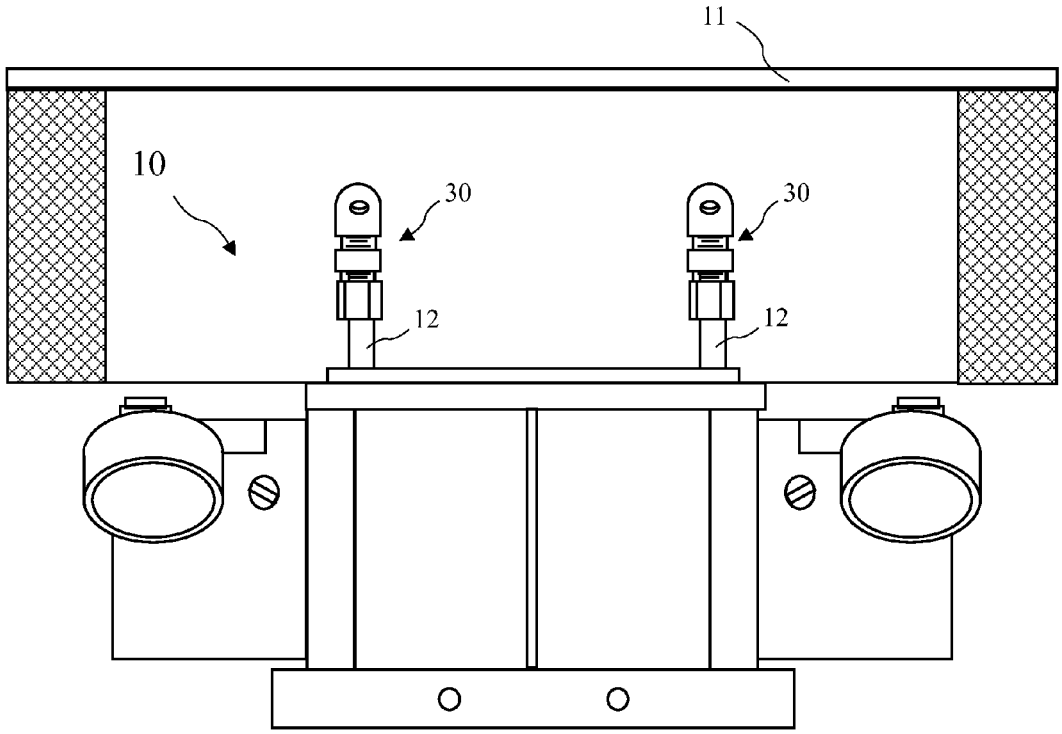
FIG. 3 is a side view of the carburetor with roll-over valves according to the present invention fitted to the vent tubes to prevent or reduce the escape of fuel if the carburetor is inverted.

A side view of the carburetor 10 with roll-over valves 30 according to the present invention fitted to the vent tubes 12 to prevent or reduce the escape of fuel 20 if the carburetor 10 is inverted as shown in FIG. 3. The roll-over valves 30 slide over the existing vent tubes 12, and are fixed to the vent tubes 12 using compression fittings integral to the roll-over valves 30. The roll-over valves 30 further include a simple ball valve which cooperates with a body portion of the roll-over valves 30 to allow a two way flow of air to maintain ambient air pressure in the float bowls 16 and close the roll-over valves 30 when the carburetor 10 is inverted to prevent or reduce the escape of fuel 20 and thereby prevent or reduce fires. The roll-over valves 30 generally reside inside an air cleaner 11 which filters air entering the engine, but may simply reside above the carburetor 10 on engines without air cleaners.

Figure 4:
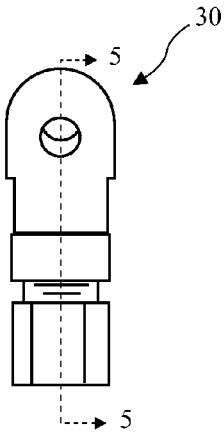
FIG. 4 is a front view of the roll-over valve according to the present invention.
Figure 5:
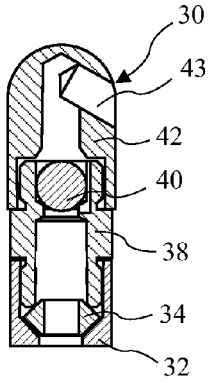
FIG. 5 is a cross-sectional view of the roll-over valve according to the present invention taken along line 5-5 of FIG. 4.

A front view of the roll-over valve 30 according to the present invention is shown in FIG. 4 and a cross-sectional view of the roll-over valve 30 taken along line 5-5 of FIG. 4 is shown in FIG. 5. The roll-over valves 30 includes a compression fitting nut 32, a compression fitting wedge element 34, a body portion 38, a ball 40, and a first cap element 42. The roll-over valves 30 slide over the float bowl vent 12 and the compression fitting nut 32 is tightened to the body portion 38 to hold the roll-over valves 30 in place. Such extremely simple installation, generally performed without removing the carburetor 10 from the engine, provides a simple and inexpensive safety device which in some cases, may save a driver's life.

The roll-over valves 30 with the first cap element 42 is a preferred design for marine use. Boats are often required to attach an inverted "J" tube to the vent tube 12 to direct any escaping fuel into the carburetor bores to prevent or reduce the chance of a fire. Unfortunately, the additional fuel often causes the engine to stall. The roll-over valves 30 are positionable to direct any escaping fuel into the carburetor bores to meet requirements while also preventing or reducing the escape of fuel to prevent or reduce engine stalling.

Figure 7B:
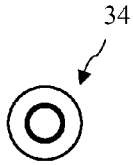
FIG. 7B is a top view of the compression fitting wedge element of the roll-over valve according to the present invention.
Figure 7A:
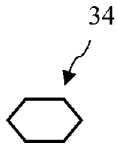
FIG. 7A is a side view of a compression fitting wedge element of the roll-over valve according to the present invention.
Figure 6B:
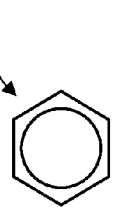
FIG. 6B is a top view of the compression fitting nut element of the roll-over valve according to the present invention.
Figure 6A:
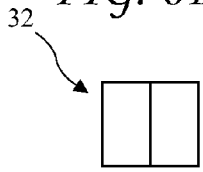
FIG. 6A is a side view of a compression fitting nut element of the roll-over valve according to the present invention.
Figure 6C:
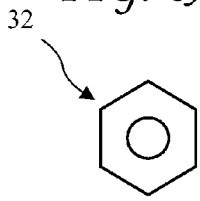
FIG. 6C is a bottom view of the compression fitting nut element of the roll-over valve according to the present invention.

A side view of a compression fitting nut element 32 of the roll-over valve roll-over valves 30 is shown in FIG. 6A, a top view of the compression fitting nut element 32 is shown in FIG. 6B, and a bottom view of the compression fitting nut element 32 is shown in FIG. 6C. A side view of a compression fitting wedge element 34 of the roll-over valve 30 is shown in FIG. 7A and a top view of the compression fitting wedge element 34 is shown in FIG. 7B. The compression fitting nut element 32 and the compression fitting wedge element 34 of the roll-over valves 30 are common elements of known compression fittings and any similar elements sized for the float bowl vent 12, for example, for a 5/16 inch tube, are suitable for use with the present invention.

Figure 8B:
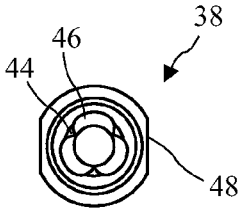
FIG. 8B is a top view of the body element of the roll-over valve according to the present invention.
Figure 9:
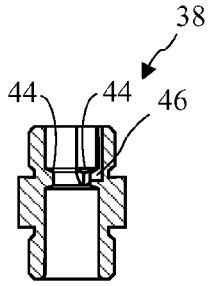
FIG. 9 is a cross-sectional view of the body element of the roll-over valve according to the present invention taken along line 9-9 of FIG. 8A.
Figure 9A:
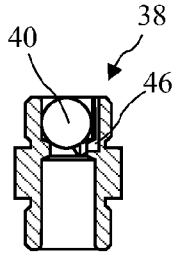
FIG. 9A is a cross-sectional view of the body element of the roll-over valve according to the present invention taken along line 9-9 of FIG. 8A with a ball element of the roll-over valve according to the present invention residing inside the body element.
Figure 8A:
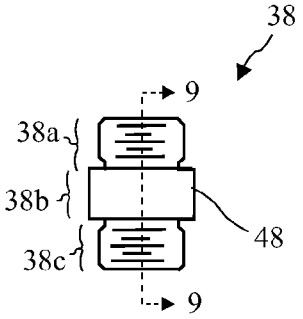
FIG. 8A is a side view of a body element of the roll-over valve according to the present invention.
Figure 8C:
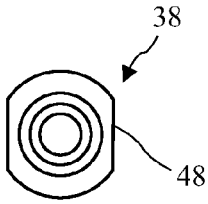
FIG. 8C is a bottom view of the body element of the roll-over valve according to the present invention.
Figure 11:
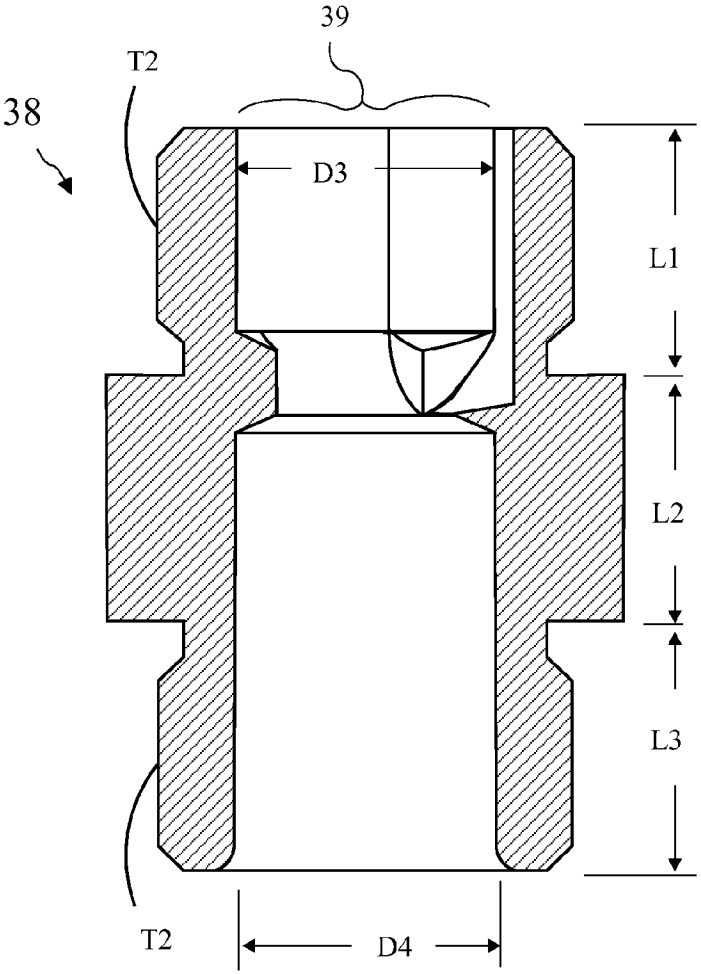
FIG. 11 is a detailed cross-sectional view of the body element of the roll-over valve according to the present invention taken along line 9-9 of FIG. 8A.

A side view of the body element 38 of the roll-over valve 30 is shown in FIG. 8A, a top view of the body element 38 is shown in FIG. 8B, a bottom view of the body element 38 is shown in FIG. 8C, a cross-sectional view of the body element 38 taken along line 9-9 of FIG. 8A is shown in FIG. 9, a second cross-sectional view of the body element 38 taken along line 9-9 of FIG. 8A with the ball element 40 of the roll-over valve according to the present invention residing inside the body element is shown in FIG. 9A, and a detailed cross-sectional view of the body element 38 taken along line 9-9 of FIG. 8A is shown in FIG. 11. The body element 38 includes an upper male threaded end 38*a* and an opposite lower male threaded end 38*c* separated by a center portion 38*b*. The female threaded ends 38*a* and 38*c* preferably have a one half by 24 female thread. The center portion 38*b* includes opposing lands 48 allowing a tool to hold or turn the body element 38 for assembly and installation.

The lower female threaded end 38*c* has a length L3 of preferably approximately 0.3 inches and is configured to cooperate with the compression fitting nut element 32 and compression fitting wedge element 34 to form a common compression fitting allowing the roll-over valves 30 to slide over the vent tube 12 and tighten.

The upper female threaded end 38*a* has a length L1 of preferably approximately 0.3 inches and includes an interior with fingers 44 separated by gaps 46. The fingers 44 support the ball 40 and the gaps 46 allow air to flow into or out of the float bowls 16 to maintain ambient air pressure inside the float bowls 16 while the engine is running. The fingers 44 and gaps 46 are preferably formed by first boring a centered passage 39 having a diameter D3 and then milling three off center cuts into the centered passage and slightly deeper than the centered passage. The cuts 46 preferably provide an approximately 0.078 inch wide gap 46 outside the center passage 39.

In some applications, for example, with high horsepower and an air scoop forcing air into bowl vents, insufficient venting of the float bowls might result in the carburetor fuel curve becoming rich from an airflow restriction through the roll-over valve. In such instances, the cuts may be made deeper to provide more than 0.078 inch wide gaps 46.

The center portion 38*b* may be mostly cylindrical with two opposing lands 48, hexagonal, square, or any shape allowing cooperation with a tool to hold or turn the center portion 38*b*. The center portion 38*b* has a length L2 which is preferably approximately 0.3 inches.

The ball 40 preferably has a diameter of approximately 0.3125 inches. The diameter of the ball 40 is slightly smaller than the inside diameter D3 of the centered passage 39 of the upper female threaded end 38*a* to allow the ball 40 to move easily within the centered passage 39, and the ball 40 preferably has a diameter approximately 0.001 less than the centered passage 39.

The ball 40 is preferably made of plastic, steel, brass, or ceramic. A plastic or light weight ball is preferred for use in off-road and water vehicles because fuel may escape from the float bowl due to vertical accelerations of the vehicle going over a jump or waves, and a light weight ball is most likely to be lifted by the flow of escaping fuel to seal the valve 30 when the vehicle does not roll over. A ceramic ball is preferred where there is a greater risk of fire. A steel ball is suitable for most racing applications.

Figure 10C:
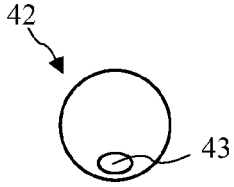
FIG. 10C is a top view of the first cap element of the roll-over valve according to the present invention.
Figure 10A:
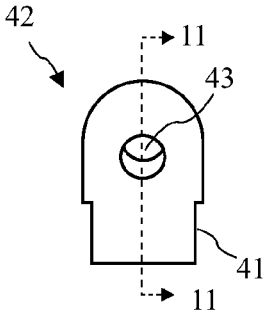
FIG. 10A is a front view of a first cap element of the roll-over valve according to the present invention.
Figure 10B:
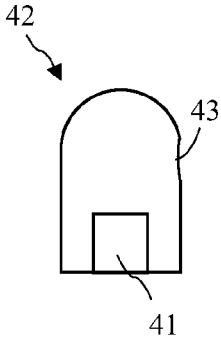
FIG. 10B is a side view of the first cap element of the roll-over valve according to the present invention.
Figure 10D:
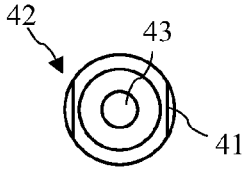
FIG. 10D is a bottom view of the first cap element of the roll-over valve according to the present invention.
Figure 12:
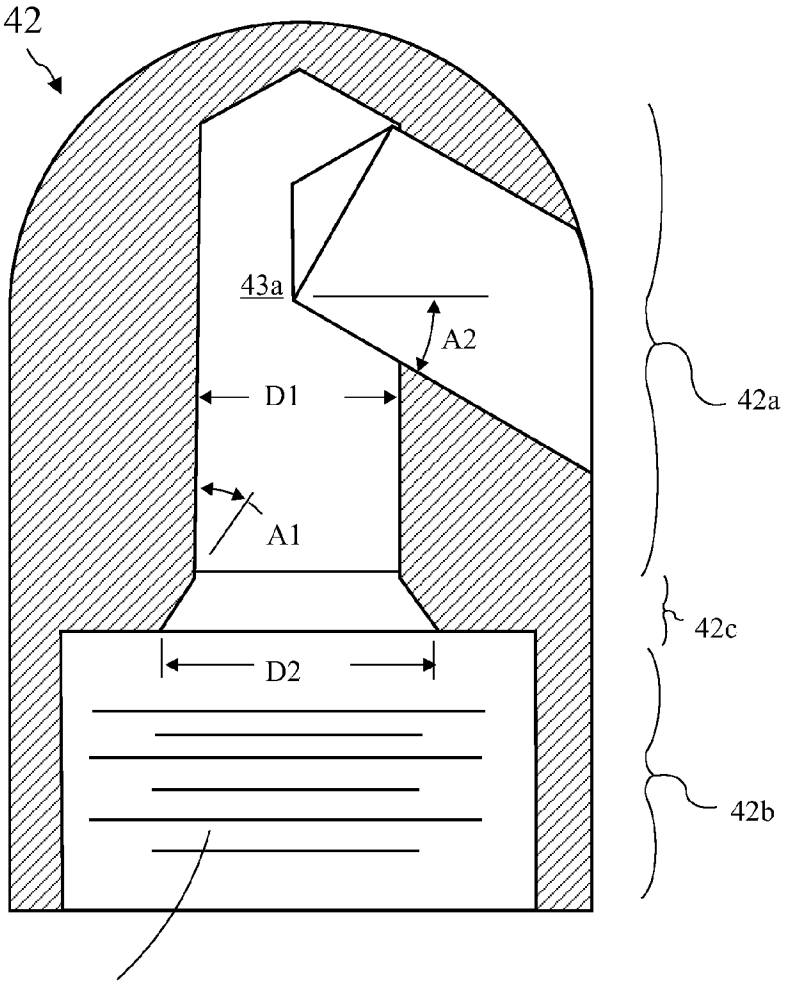
FIG. 12 is a detailed cross-sectional view of the first cap element of the roll-over valve according to the present invention taken along line 11-11 of FIG. 10A.

A front view of the first cap element 42 of the roll-over valve 30 according to the present invention is shown in FIG. 10A, a side view of the first cap element 42 is shown in FIG. 10B, a top view of the first cap element 42 is shown in FIG. 10C, a bottom view of the first cap element 42 is shown in FIG. 10B and a detailed cross-sectional view of the first cap element 42 taken along line 11-11 of FIG. 10A is shown in FIG. 12. The lower cap portion 42*b* of the first cap element 42 includes an inside female thread T1 for cooperating with the upper male threaded end 38*a* of the body element 38 for assembling the roll-over valves 30. The thread T1 is preferably a one half by 24 thread. An upper cap portion 42*a* includes a port 43*a* connecting the vent tube 12 to ambient air pressure. The port 43*a* reached upward and then turns down to an angle A2 below horizontal, the angle A2 preferably approximately 30 degrees. The port 43*a* has an inside diameter D1, the diameter D1 preferably approximately 0.218 inches. A frusto-conical base portion 42*c* connects the port 43*a* to the lower cap portion 42*b*. The frusto-conical base portion 42*c* having an angle A1, the angle A1 preferably approximately 35 degrees from vertical.

Figure 13B:
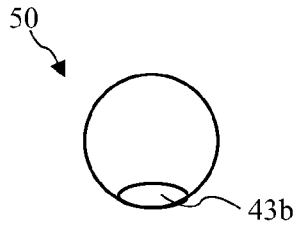
FIG. 13B is a top view of the second cap element of the roll-over valve according to the present invention.
Figure 13A:
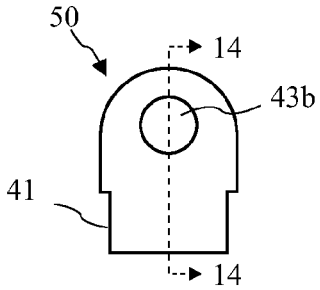
FIG. 13A is a front view of a second cap element of the roll-over valve according to the present invention.
Figure 14:
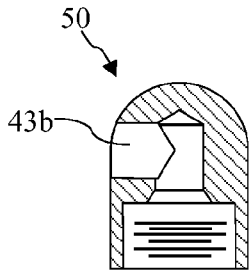
FIG. 14 is a cross-sectional view of the second cap element of the roll-over valve according to the present invention taken along line 14-14 of FIG. 13A.

A front view of a second cap element 50 of the roll-over valve 30 according to the present invention is shown in FIG. 13A, a top view of the second cap element 50 is shown in FIG. 13B, and a cross-sectional view of the second cap element 50 taken along line 14-14 of FIG. 13A is shown in FIG. 14. The second cap element 50 has a port 43*b* having a vertical portion like the port 43*a* but replacing the downward sloping portion with a horizontal portion. The second cap element 50 is otherwise like the first cap element 42

Figure 15B:
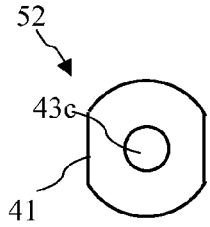
FIG. 15B is a top view of the third cap element of the roll-over valve according to the present invention.
Figure 16:
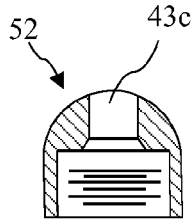
FIG. 16 is a cross-sectional view of the third cap element of the roll-over valve according to the present invention taken along line 16-16 of FIG. 15A.
Figure 15A:
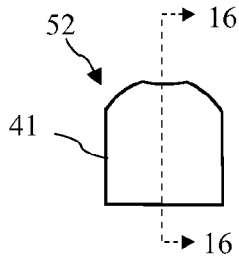
FIG. 15A is a front view of a third cap element of the roll-over valve according to the present invention.

A front view of a third cap element 52 of the roll-over valve 30 according to the present invention is shown in FIG. 15A, a top view of the second cap element 52 is shown in FIG. 15B, and a cross-sectional view of the third cap element 52 taken along line 16-16 of FIG. 15A is shown in FIG. 16. The third cap element 52 has a port 43*c* having a vertical portion like the port 43*a* but the vertical portion continues through the top of the third cap element 52. The third cap element 52 is otherwise like the first cap element 42. A roll-over valve including the third cap element 52 is suitable for most racing uses.

Figure 17B:
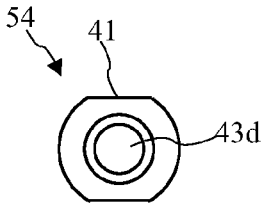
FIG. 17B is a top view of the fourth cap element of the roll-over valve according to the present invention.
Figure 17A:
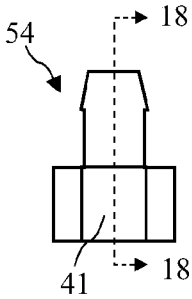
FIG. 17A is a front view of a fourth cap element of the roll-over valve according to the present invention.
Figure 18:
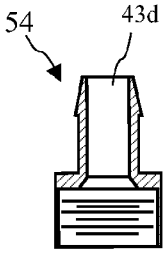
FIG. 18 is a cross-sectional view of the fourth cap element of the roll-over valve according to the present invention taken along line 18-18 of FIG. 17A.

A front view of a fourth cap element 54 of the roll-over valve 30 according to the present invention is shown in FIG. 17A, a top view of the fourth cap element 54 is shown in FIG. 17B, and a cross-sectional view of the fourth cap element 54 taken along line 18-18 of FIG. 17A is shown in FIG. 18. The fourth cap element 54 has a port 43*d* having a vertical portion like the port 43*a* but the vertical portion continues above the top of the fourth cap element 54 into a barbed hose fitting. The fourth cap element 54 is otherwise like the first cap element 42. A roll-over valve including the fourth cap element 54 is suitable for race boats and off-road racing uses where safety requirements require that a tube be connected to the vent tube 12 (see FIG. 1A) to carry any escaping fuel to a holding tank. The fourth cap element 54 provides the barbed hose fitting for connection of the tube to meet the safety requirements.

Figure 19:
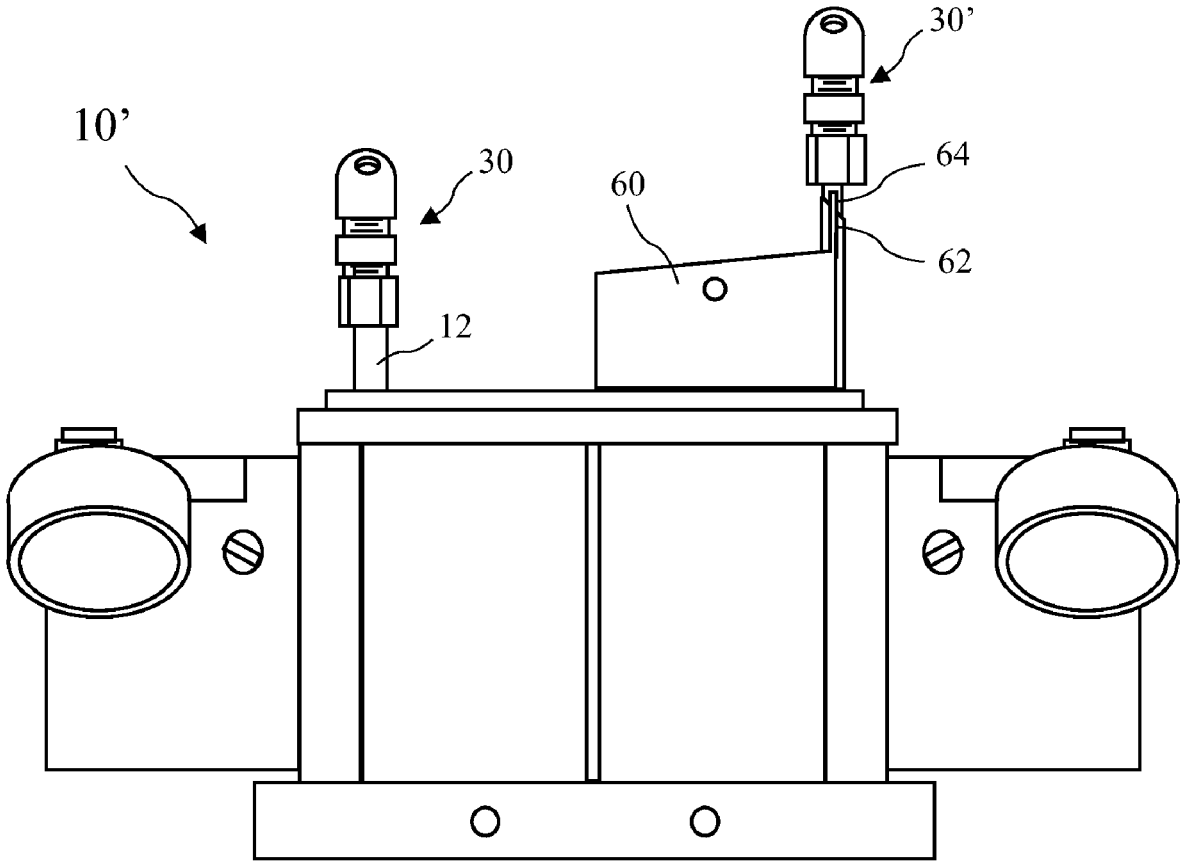
FIG. 19 shows a carburetor having a housing above the primary side of the carburetor with a roll-over valve according to the present invention.

A second carburetor 10' with a choke housing 60 above the primary side of the carburetor is shown in FIG. 19. The normal float bowl vent 12 is present on the secondary side of the carburetor 10', but not on the primary side where an integral float bowl vent 62 is formed as part of the choke housing 60. In one embodiment, a float bowl vent extension 64 is attached inside the integral float bowl vent 62, for example, by high strength epoxy. A second roll-over valve 30' may then be attached to the float bowl vent extension 64 using a compression fitting. In another embodiment, the choke housing 60 may be machined to allow the roll-over valve 30 to reside directly over the integral float bowl vent 62.

While a roll-over valve is described above attached using a compression fitting, in some cases, space may be limited, and a shorter roll-over valve may be attached by forming threads on the outside of the float bowl vent, or by high strength epoxy, and any rollover valve having the ball check structure described above and connected serially with the vent tube, wherein all of the flow through the vent tube is restricted to also pass through the roll-over valve, is intended to come within the scope of the present invention.

In some applications requirements exist that the vent tube 12 be connected to an opposite vent tube 12, or to another structure, and the barbed end of the fourth cap element 54 is provided for such applications.

The roll-over valve 30 may be made from metal or a high strength plastic, and is preferably made from brass.

While the invention herein disclosed has been described by means of specific embodiments and applications thereof, numerous modifications and variations could be made thereto by those skilled in the art without departing from the scope of the invention set forth in the claims.

I claim:

1. A carburetor and roll-over valve comprising:

a carburetor having at least one float bowl containing fuel;

a cylindrical vertical vent tube extending upward from the carburetor and in fluid communication with the respective at least one float bowl;

a roll-over valve fixed to the vent tube, the roll-over valve comprising:

a compression fitting for forming a seal to the vent tube;

a vertical centered passage though the roll-over valve;

an inside shoulder forming a narrowing of the vertical centered passage;

a vertically sliding obstruction residing inside the vertical centered passage and residing above the inside shoulder;

bypass cuts in the vertical centered passage allowing air to flow past the vertically sliding obstruction into and out of the float bowl to equalize pressure in the float bowl with ambient air pressure when the carburetor is upright;

a port above the vertical centered passage in communication with ambient air; and a narrowing between the vertical centered passage and the port to block passage of the vertically sliding obstruction into the port and to cooperate with the vertically sliding obstruction to restrict an escape of fuel from the float bowl when the carburetor is inverted.

2. The carburetor and roll-over valve of claim 1, wherein the inside shoulder is above the compression fitting.

3. The carburetor and roll-over valve of claim 1, wherein the vertically sliding obstruction is spherical in shape.

4. The carburetor and roll-over valve of claim 1, wherein the port extends vertically above the vertical centered passage.

5. The carburetor and roll-over valve of claim 4, wherein the narrowing between the vertical centered passage and the port is a frusto-conical narrowing.

6. The carburetor and roll-over valve of claim 4, wherein the port extends vertically and then bends and extends below horizontal to an exterior surface of the roll-over valve.

7. The carburetor and roll-over valve of claim 4, wherein the port extends vertically and then bends and extends horizontal to an exterior surface of the roll-over valve.

8. The carburetor and roll-over valve of claim 4, wherein the port extends vertically and extends above the roll-over valve forming a barbed hose fitting for connection to a hose carrying any escaping fuel to a container.

9. The carburetor and roll-over valve of claim 1, wherein the vertically sliding obstruction is a light weight material for use in off-road and water vehicles.

10. The carburetor and roll-over valve of claim 1, wherein the vertically sliding obstruction is a ceramic material for use when fires are likely.

11. A carburetor and roll-over valve comprising:

a carburetor having at least one float bowl containing fuel;

a cylindrical vertical float bowl vent tube extending upward from the carburetor and in fluid communication with the respective at least one float bowl;

a roll-over valve fixed to the vent tube, the roll-over valve comprising:

a compression fitting nut;

a compression fitting wedge;

a body portion comprising:

a lower male threaded portion threadedly cooperating with the compression fitting nut to squeeze the compression fitting wedge radially to fix the roll-over valve on the vent tube;

a center portion having an outside surface for cooperating with a tool;

an upper male threaded portion;

a vertical centered passage though the body portion;

an inside shoulder forming a narrowing of the vertical centered passage;

a vertically sliding obstruction residing inside the vertical centered passage and residing above the inside shoulder; and bypass cuts in the vertical centered passage allowing air to flow past the vertically sliding obstruction into and out of the float bowl to equalize pressure in the float bowl with ambient air pressure when the carburetor is upright;

a top cap comprising:

a cap lower portion having female threads for threadedly cooperating with the upper male threaded portion of the body portion;

a port above the vertical centered passage in communication with ambient air; and a narrowing between the cap lower portion and the port to block passage of the vertically sliding obstruction into the port and to restrict an escape of fuel from the float bowl when the carburetor is inverted.

12. A carburetor and roll-over valve comprising:

a carburetor having at least one float bowl containing fuel;

a vertical vent passage extending upward from the carburetor and in fluid communication with the respective at least one float bowl;

a roll-over valve connected serially with the vent tube wherein all of a flow through the vent tube is restricted to also pass through the roll-over valve, the roll-over valve comprising:

a vertical centered passage though the roll-over valve;

an inside shoulder forming a narrowing of the vertical centered passage;

a vertically sliding obstruction residing inside the vertical centered passage and residing above the inside shoulder;

bypass cuts in the vertical centered passage allowing air to flow past the vertically sliding obstruction into and out of the float bowl to equalize pressure in the float bowl with ambient air pressure when the carburetor is upright;

a port above the vertical centered passage in communication with ambient air; and a narrowing between the vertical centered passage and the port to block passage of the vertically sliding obstruction into the port and to cooperate with the vertically sliding obstruction to restrict an escape of fuel from the float bowl when the carburetor is sufficiently tilted.

13. The carburetor and roll-over valve of claim 12, wherein the vent tube is an integral float bowl vent formed in a choke housing of the carburetor and the roll-over valve is connected to the integral float bowl vent by a float bowl vent extension connected to the integral float bowl vent and by a compression fitting in a lower portion of the roll-over valve.

14. The carburetor and roll-over valve of claim 12, wherein the vent tube is an integral float bowl vent formed in a choke housing of the carburetor and a choke housing of the carburetor is machined to allow the roll-over valve to be connected to an exposed portion of the integral float bowl vent by a compression fitting in a lower portion of the roll-over valve.

* * * * *